US009296521B2

(12) United States Patent
Murray

(10) Patent No.: US 9,296,521 B2
(45) Date of Patent: Mar. 29, 2016

(54) FLEXIBLE POUCH WITH DRIP PAD

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 14/492,729

(22) Filed: Sep. 22, 2014

(65) Prior Publication Data

US 2015/0086138 A1 Mar. 26, 2015

Related U.S. Application Data

(60) Provisional application No. 61/880,310, filed on Sep. 20, 2013.

(51) Int. Cl.

| | |
|---|---|
| ***B65D 30/16*** | (2006.01) |
| ***B65D 33/02*** | (2006.01) |
| ***B65D 75/00*** | (2006.01) |
| *B65D 75/58* | (2006.01) |

(52) U.S. Cl.

CPC ..... *B65D 33/02* (2013.01); *B65D 75/008* (2013.01); *B65D 75/5877* (2013.01); *Y10T 29/49826* (2015.01)

(58) Field of Classification Search

CPC ..... B65D 31/06; B65D 33/02
USPC ..... 383/104, 121, 121.1, 119, 120
See application file for complete search history.

(56) References Cited

U.S. PATENT DOCUMENTS

| | | | | | |
|---|---|---|---|---|---|
| 815,255 | A * | 3/1906 | Bell | 383/113 | |
| 3,484,037 | A * | 12/1969 | Kugler | 383/21 | |
| 3,742,994 | A * | 7/1973 | Pensak | 383/3 | |
| 3,940,052 | A * | 2/1976 | McHugh | 383/121.1 | |
| 4,512,463 | A * | 4/1985 | Ward | 206/216 | |
| 5,772,332 | A * | 6/1998 | Geller | 383/119 | |
| 6,231,237 | B1 * | 5/2001 | Geller | 383/119 | |
| 7,524,111 | B1 * | 4/2009 | Williams | 383/104 | |
| 8,228,197 | B2 | 7/2012 | Murray | | |
| 8,468,782 | B2 * | 6/2013 | Michalsky | B31B 19/74 156/229 | |
| 8,745,836 | B2 | 6/2014 | Murray | | |
| 2008/0247682 | A1 | 10/2008 | Murray | | |
| 2011/0108572 | A1 | 5/2011 | Murray | | |
| 2013/0195382 | A1 | 8/2013 | Murray | | |

FOREIGN PATENT DOCUMENTS

| | | | | |
|---|---|---|---|---|
| JP | 2001270534 A * | 10/2001 | ..... | B65D 30/18 |

* cited by examiner

*Primary Examiner* — Jes F Pascua
(74) *Attorney, Agent, or Firm* — Dinsmore & Shohl LLP

(57) ABSTRACT

The present invention is related to container assemblies for holding a product. The container assembly includes a flexible pouch and a base. The flexible pouch includes a gusset with a bottom surface. The base is secured to the bottom surface of the gusset. The weight applied to the gusset is supported in part by the base, thereby transferring weight away from a peripheral portion of the flexible pouch that would otherwise support the weight in absence of the base. A method to produce the container assembly includes providing a flexible pouch with a gusset, and providing a base. The base is then secured to the gusset.

4 Claims, 4 Drawing Sheets

FLEXIBLE POUCH WITH DRIP PAD

CROSS-REFERENCE TO RELATED APPLICATIONS

This application claims priority of U.S. Provisional Patent Application Ser. No. 61/880,310 filed on Sep. 20, 2013, which is incorporated herein by reference.

FIELD OF THE INVENTION

The present invention is related to container assemblies for holding a product. Specifically, containers made from flexible laminate material that include a gusset, such as stand flexible pouches, for holding products such as juice, beer, wine, sports drinks, granular powder mixes, etc.

BACKGROUND OF THE INVENTION

Stand up flexible pouches are known for packaging a variety of products. The pouches usually have a triangular cross section when viewed from the side. Typically the pouches have a front panel and a rear panel and a bottom gusset. The gusset extends between the front and rear panel. The gusset is sealed, for example by ultra-sonic welding, to the front and back panels so that there is a peripheral portion that extends from where the gusset is welded to the very bottom of the panels. When the pouch is in an upright position, the weight of the contents is supported by the gusset. The weight forces the gusset down in the center to contact a surface which the pouch is standing on. The pouch is supported in an upright position by the peripheral edge portion and the gusset resting on the surface. However, for larger stand up pouches containing substantial volume, the weight of the contents is frequently so great that the peripheral edge crumples under the weight of the contents thereby hindering the ability of the pouch to effectively stand up.

SUMMARY OF THE INVENTION

The claims of the present disclosure are directed to a container assembly for packaging a product. The container assembly includes a flexible pouch and a base. The flexible pouch includes a gusset with a bottom surface. The base is secured to the bottom surface of the gusset.

When the flexible pouch is in a standup position, and contains a product, weight of the product is supported in part by the gusset. The weight applied to the gusset is supported in part by the base, thereby transferring weight away from a peripheral portion of the flexible pouch that would otherwise support the weight in absence of the base. Transfer of weight away from the peripheral portion to the base helps to stabilize the flexible pouch in an upright position.

A method to produce the container assembly includes providing a flexible pouch with a gusset, and providing a base. The base is then secured to the gusset.

DETAILED DESCRIPTION OF THE PREFERRED EMBODIMENTS

Figure 2:
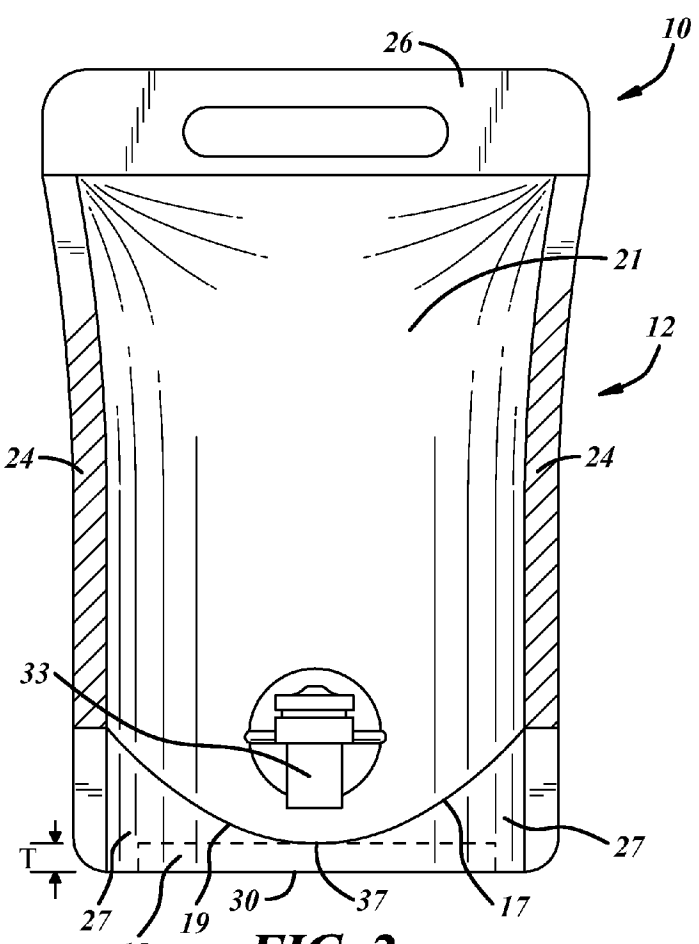
FIG. 2 is a front elevational view of the container embodiment of FIG. 1.
Figure 1:
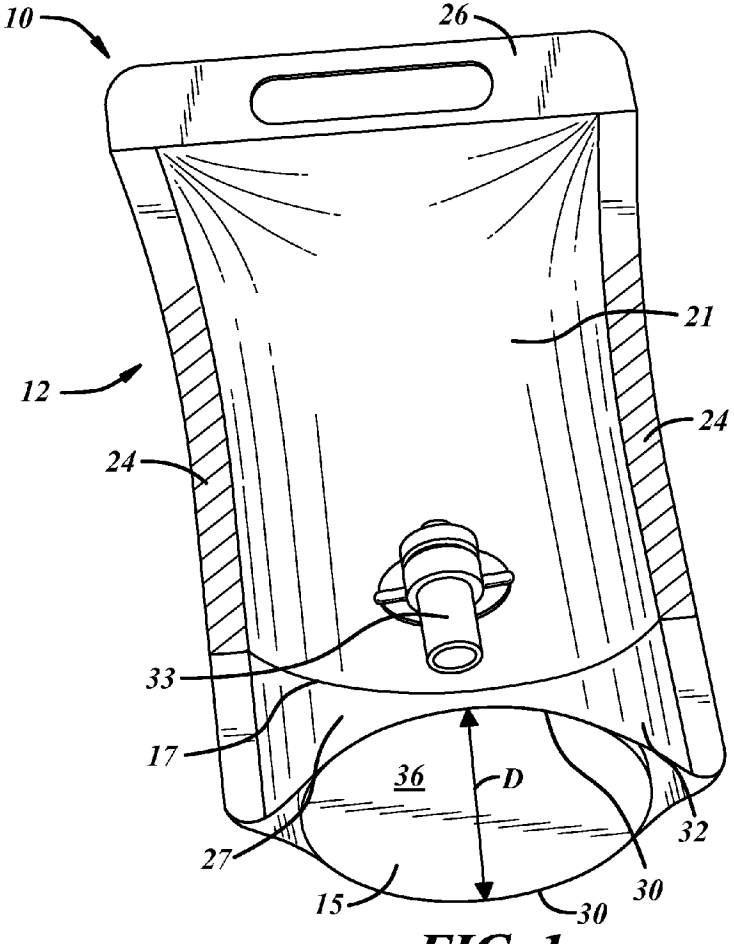
FIG. 1 is a front perspective view of a container embodiment.

With reference now to FIGS. 1-6, one embodiment of a container assembly 10 for storing product is described. The container assembly 10 includes a flexible pouch 12 and a base 15. The flexible pouch 12 has a gusset 17 with a bottom surface 19. The base 15 is secured to the bottom surface 19 of the gusset 17.

The flexible pouch 12 is formed from one or more sheets of flexible laminate material either folded, overlaid, or a combination there of, to create a front panel 21, a back panel 22 and the gusset 17. The front panel 21 is sealed to the back panel 22 along one or more side sealed portions 24 and a top sealed portion 26. The gusset 17 extends between the front panels 21, back panel 22 and side sealed portions 24 to form a bottom for the flexible pouch 12. At a bottom sealed portion 27, part of the gusset 17 is sealed to an inner surface of the front panel 21 and a separate part of the gusset 17 is sealed to an inner surface of the back panel 22. The gusset 17 overlaps and is sealed to the front panel 21 and back panel 22 upwardly from a bottom edge 30 of the front panel 21 and back panel 22 to form a peripheral portion 32 of the flexible pouch 12. The sealing is achieved the applied heat and pressure, ultra-sonic welding, or any other suitable method known to those skilled in the art. It is understood and appreciated that while the shown embodiment of the flexible pouch has a pair of side sealed portion 24, formation of a flexible pouch with a single side sealed portion is possible. For example, when the flexible pouch is made from a sheet of laminate material folded along one of the sides over onto itself.

The flexible pouch includes a spout 33 installed on the front panel 21 to allow access to product stored by the container assembly 10. Other types of access to the interior of the container may be utilized, such as a fitment (not shown) mounted between the front panel 21 and the back panel 22 along the top sealed portion 26, or included features such as press and seal closures, tear away portions, or any other known and suitable design.

Figures 3, 4, 5:
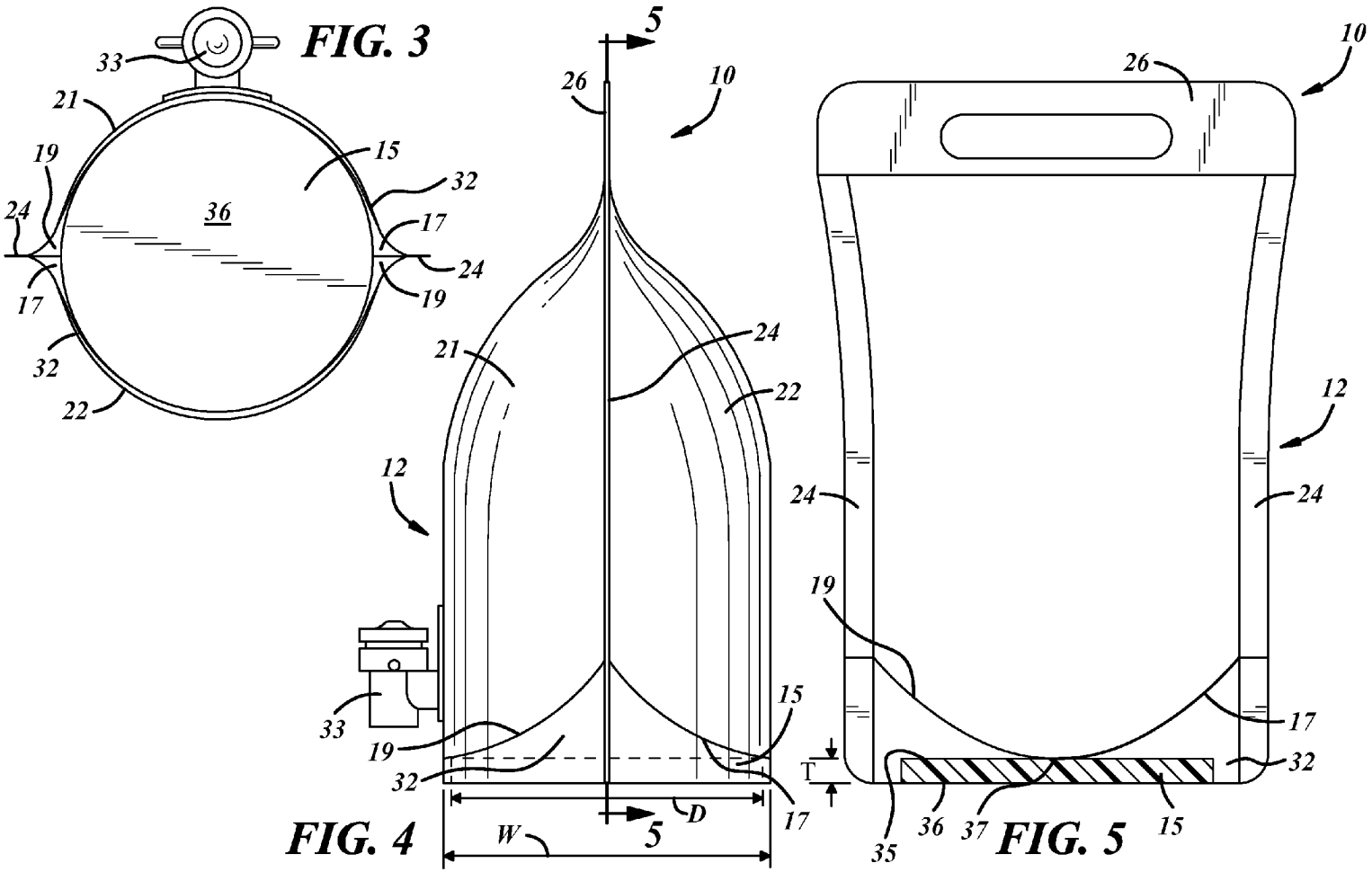
FIG. 3 is a bottom plan view of the container embodiment of FIG. 1.
FIG. 4 is a side elevational view of the container embodiment of FIG. 1.
FIG. 5 is a section view of the container embodiment of FIG. 1.
Figure 6:
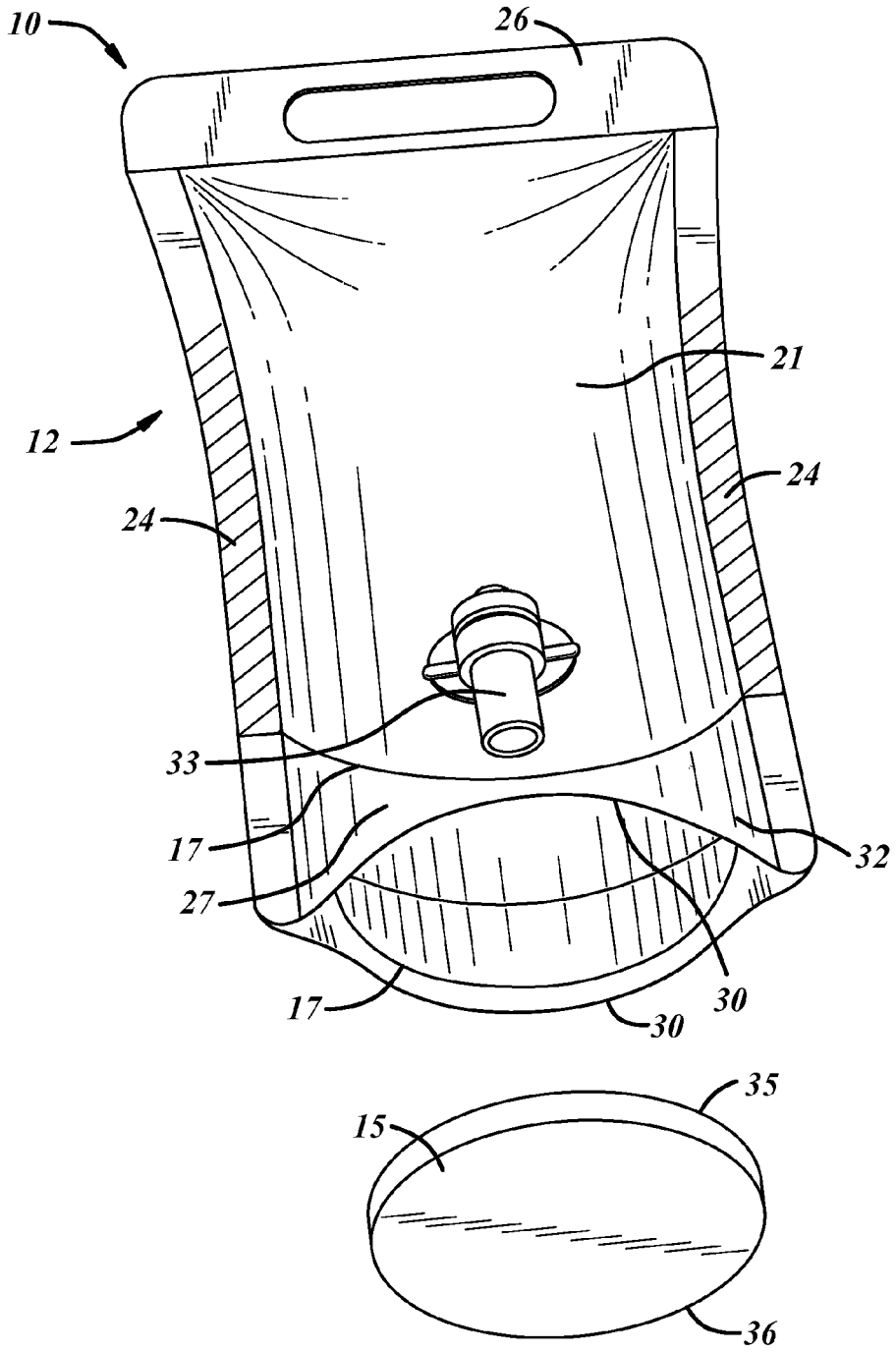
FIG. 6 is a perspective view of a base a flexible pouch before assembly.

The base 15 is affixed to the bottom surface 19 of the gusset. In the preferred embodiment, the base 15 is circular having a diameter D slightly less than the width W of the flexible pouch at the bottom between the front panel 21 panel and back panel 22 when the flexible pouch 12 is viewed from the side, as shown in FIG. 4. However, the base 17 may have any particular shape as long as the base 15 is able to fit between the front panel 21 and back panel 22 at the bottom of the flexible pouch 12 to secure to the gusset 17. The circular form of the base 15 allows the base 15 to be installed on the gusset 17 without concern as to the rotational alignment of the base 17 relative to the flexible pouch 12.

The base 15 has a top surface 35 and a bottom surface 36. The top surface 35 and bottom surface 36 of the base 15 are planar and parallel, providing a generally uniform thickness to the base 15. The thickness T of the base 15 is generally equal to or greater than vertical distance between the bottom edge 30 and a location 37 on the gusset 17 contacting the base 15. The location 37 of contact between the gusset 17 and the base 15 is typically near the center of the gusset 17, as the center is typically the lowest point on the gusset 17 when the flexible pouch 12 is in a stand up position.

In another embodiment, an alternate base 15*a* may be used with the flexible pouch 12 to create the container assembly 12. The alternate base 15*a* includes a top surface 35*a* and a bottom surface 36*a*. The bottom surface 36*a* is generally planar. The top surface 35*a* is contoured. The contour of the top surface 35*a* is designed to complement the contour of the bottom surface 19 of the gusset 17. The complimentary contoured top surface 35*a* allows for an increase in surface area contact between the gusset 17 and the base 15*a*. As a result of the top surface 15*a*, the base 15*a* has varying thickness depending on the location on the base 15*a* where the thickness is measured. The varying thickness of the base 15*a* is determined such that the thickness at any given point on the base 15*a* is generally equal to or greater than vertical distance between the bottom edge 30 and the location on the gusset 17 contacting the base 15*a*.

The base 15 15*a* is secured to the gusset 17 in a suitable manner such as an adhesive on double sided tape. The base 15, 15*a* is formed of a lightweight strong material such as a compressed foam, Styrofoam material, or cardboard. However, any suitable rigid material may be used.

When the container assembly 12 is filled with product, the container 12 rests on the base 15, 15*a* and on the peripheral portion 32 of the flexible pouch 12. The base 15, 15*a*, however, bears much of the weight of the product thereby permitting the peripheral portion 32 to support the front panel 21 and back panel 22 maintaining the container assembly 10 is a stabilized stand up position.

Figure 10:
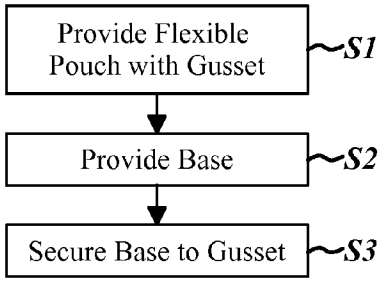
FIG. 10 is a flowchart of a method of to form a container.
Figure 9:
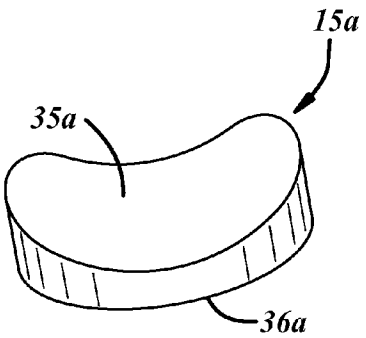
FIG. 9 is a perspective view of a base embodiment used in the container of FIG. 7.
Figure 8:
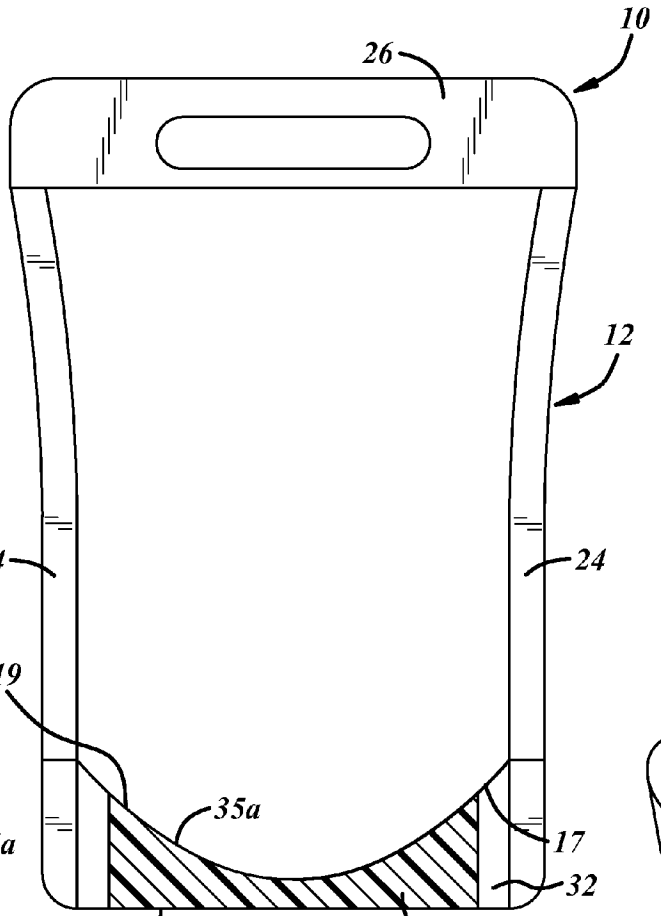
FIG. 8 is a section view of the container embodiment of FIG. 7.
Figure 7:
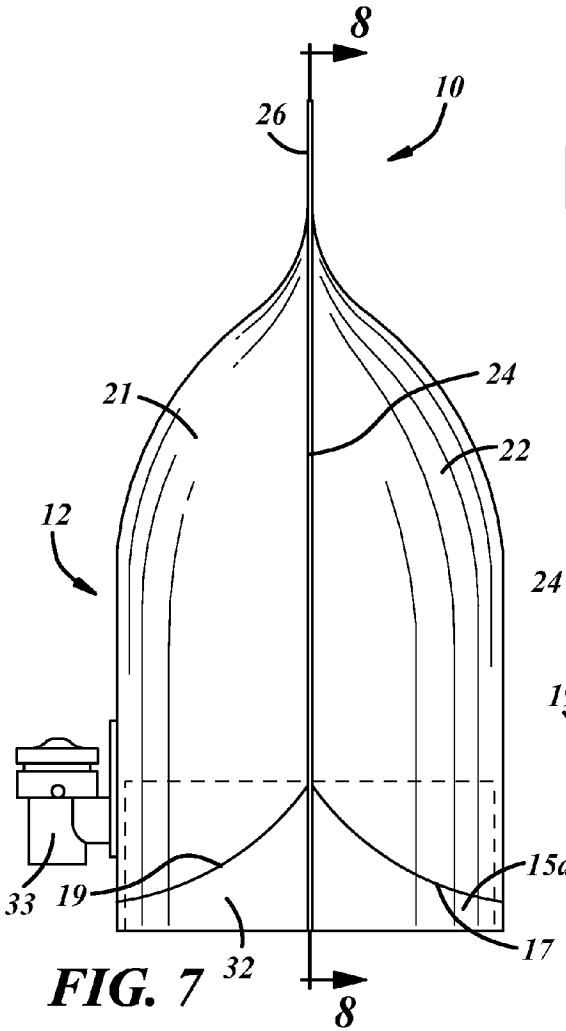
FIG. 7 is a side elevational view of another embodiment of a container.

With reference to FIG. 10, a method to make a stabilized container assembly requires a step S1 providing a flexible pouch with a gusset. The provided flexible pouch with the gusset is similar to that described above. At step S2 a base is provided. The base is similar to that described above. At step S3, after the flexible pouch and base have been provide, the base is secured to the gusset. The base is secured to the gusset with the use of adhesive, such as glue, double sided tape, or any other suitable means known to those skilled in the art.

The invention is not restricted to the illustrative examples described above. Examples described are not intended to limit the scope of the invention. Changes therein, other combinations of elements, and other applications will occur to those skilled in the art without deviating from the spirit of the described invention.

The invention claimed is:

1. A container assembly for holding a product comprising:

a flexible pouch including a walled portion defining a peripheral bottom edge of the flexible pouch, and a pair of gussets, each of the pair of gussets disposed on opposite ends of the flexible pouch, the pair of gussets defining a contoured bottom surface suspended by the walled portion; and a rigid base configured to support the contoured bottom surface of the flexible pouch;

wherein the rigid base has a top surface dimensioned the same as the contoured bottom surface so as to fittingly engage entirely the contoured bottom surface of the flexible pouch and a bottom surface which is generally planar, the top surface of the rigid base engaging the entirety of the contoured bottom surface of the flexible pouch so as to stabilize the flexible pouch in an upright position by supporting weight of the product acting on the pair of gussets that would otherwise be transferred to a peripheral portion of the flexible pouch.

2. The container assembly of claim 1, wherein the base is circular.

3. The container assembly of claim 2, wherein:

the base has a diameter, the flexible pouch has a width, and the diameter of the base is less than the width of the flexible pouch.

4. A method for making a stabilized container assembly comprising the steps of:

providing a flexible pouch having a walled portion defining a peripheral bottom edge of the flexible pouch and a pair of gussets disposed on opposite sides of the flexible pouch, the pair of gussets defining a contoured bottom surface, the contoured bottom surface suspended by the walled portion;

providing a rigid base, the rigid base has a top surface dimensioned the same as the contoured bottom surface of the flexible pouch so as to fittingly engage entirely the contoured bottom surface, the rigid base further including a bottom surface opposite the top surface, the bottom surface is generally planar; and securing the top surface of the base to the contoured bottom surface of the flexible pouch, wherein the top surface of the rigid base works in concert with the contoured bottom surface of the gusset so as to stabilize the flexible pouch in an upright position by supporting weight of the product acting on the pair of gussets that would otherwise be transferred to a peripheral portion of the flexible pouch.

* * * * *